US012114823B2

(12) United States Patent
Cantrell et al.

(10) Patent No.: US 12,114,823 B2
(45) Date of Patent: Oct. 15, 2024

(54) FLUID FLOW STRUCTURE AND METHOD OF USE FOR CONTINUOUS MOTION WASHING MACHINE

(71) Applicant: Electrolux Professional, Inc., Vicksburg, MS (US)

(72) Inventors: John W. Cantrell, Leawood, KS (US); Mark Churchill, Grain Valley, MO (US); David Robert Gast, Lenexa, KS (US); Michael P. Licata, Lee's Summit, MO (US); Joshua H. Huisenga, Kansas City, MO (US); John N. McCreight, Leawood, KS (US); Bryon J. London, Prairie Village, KS (US)

(73) Assignee: ELECTROLUX PROFESSIONAL, INC., Vicksburg, MS (US)

( * ) Notice: Subject to any disclaimer, the term of this patent is extended or adjusted under 35 U.S.C. 154(b) by 356 days.

(21) Appl. No.: 17/087,406

(22) Filed: Nov. 2, 2020

(65) Prior Publication Data

US 2021/0068611 A1 Mar. 11, 2021

Related U.S. Application Data

(60) Continuation of application No. 16/042,824, filed on Jul. 23, 2018, now Pat. No. 10,835,097, which is a (Continued)

(51) Int. Cl.

| | |
|---|---|
| ***A47L 15/02*** | (2006.01) |
| ***A47L 15/00*** | (2006.01) |
| ***A47L 15/08*** | (2006.01) |

(52) U.S. Cl.
CPC ..... *A47L 15/02* (2013.01); *A47L 15/00* (2013.01); *A47L 15/0092* (2013.01); *A47L 15/08* (2013.01)

(58) Field of Classification Search
None
See application file for complete search history.

(56) References Cited

U.S. PATENT DOCUMENTS

| | | | |
|---|---|---|---|
| 3,208,732 | A | 9/1965 | Ranson |
| 3,212,758 | A | 10/1965 | Ranson |

(Continued)

FOREIGN PATENT DOCUMENTS

| | | | |
|---|---|---|---|
| AU | 2010238773 | B2 | 10/2016 |
| AU | 2016244318 | A1 | 11/2016 |

(Continued)

OTHER PUBLICATIONS

"English Machine Translation DE 10259763".

(Continued)

*Primary Examiner* — Cristi J Tate-Sims
(74) *Attorney, Agent, or Firm* — Kutak Rock LLP

(57) ABSTRACT

A fluid flow structure for a washing machine is located within a wash tank of the washing machine, which includes a fluid flow guide surface, and a support for the guide surface. The guide surface includes at least one region contoured inconsistently from the contour of at least one corresponding wall of the washing machine wash tank. The contour of the guide surface is generally curved so as to aide in reducing and/or preventing the pinning of items that often occurs in rectangular wash tanks of the prior art. The support for the guide surface creates a gap between the guide surface and at least one wall of the washing machine wash tank.

10 Claims, 9 Drawing Sheets

Related U.S. Application Data division of application No. 12/765,838, filed on Apr. 22, 2010, now Pat. No. 10,028,636, application No. 17/087,406, filed on Nov. 2, 2020 is a continuation of application No. 15/695,888, filed on Sep. 5, 2017, now Pat. No. 10,820,776, which is a continuation of application No. 14/379,190, filed as application No. PCT/US2013/026705 on Feb. 9, 2013, now Pat. No. 9,750,388.

(60) Provisional application No. 61/171,752, filed on Apr. 22, 2009, provisional application No. 61/177,105, filed on May 11, 2009, provisional application No. 61/227,686, filed on Jul. 22, 2009, provisional application No. 61/231,987, filed on Aug. 6, 2009, provisional application No. 61/233,811, filed on Aug. 13, 2009, provisional application No. 61/236,801, filed on Aug. 25, 2009, provisional application No. 61/255,083, filed on Oct. 26, 2009, provisional application No. 61/266,430, filed on Dec. 3, 2009, provisional application No. 61/600,581, filed on Feb. 17, 2012.

(56) References Cited

U.S. PATENT DOCUMENTS

| | | | | |
|---|---|---|---|---|
| 3,226,095 | A | 12/1965 | Ranson | |
| 3,314,659 | A | 4/1967 | Ranson | |
| 4,712,351 | A | 12/1987 | Kasprzak | |
| 4,773,435 | A | 9/1988 | Ikeda et al. | |
| 4,773,436 | A | 9/1988 | Cantrell et al. | |
| 6,115,541 | A | 9/2000 | Rhodes | |
| 6,739,348 | B2 * | 5/2004 | Inch | A47L 15/0092 134/186 |
| 7,228,975 | B2 | 6/2007 | Yang et al. | |
| 7,854,030 | B2 | 12/2010 | Lee et al. | |
| 9,027,575 | B2 | 5/2015 | Cantrell et al. | |
| 9,750,388 | B2 | 9/2017 | John et al. | |
| 10,028,636 | B2 | 7/2018 | Cantrell et al. | |
| 10,820,776 | B2 * | 11/2020 | Cantrell | A47L 15/08 |
| 10,835,097 | B2 | 11/2020 | Cantrell et al. | |
| 2003/0041886 | A1 * | 3/2003 | Cantrell | A47L 15/08 134/182 |
| 2003/0041887 | A1 | 3/2003 | Inch et al. | |
| 2004/0107977 | A1 | 6/2004 | Cantrell et al. | |
| 2004/0244822 | A1 | 12/2004 | Cantrell et al. | |
| 2005/0028847 | A1 | 2/2005 | Kaczmarek | |
| 2006/0196528 | A1 | 9/2006 | Jarvis | |
| 2008/0011328 | A1 | 1/2008 | Cantrell et al. | |
| 2008/0093314 | A1 | 4/2008 | Classen | |
| 2008/0099055 | A1 | 5/2008 | Lemley | |
| 2010/0224220 | A1 | 9/2010 | Cantrell et al. | |
| 2011/0017241 | A1 | 1/2011 | Cantrell et al. | |
| 2011/0174339 | A1 | 7/2011 | Cantrell et al. | |
| 2012/0298140 | A1 | 11/2012 | Cantrell et al. | |
| 2015/0013730 | A1 | 1/2015 | John et al. | |
| 2018/0055331 | A1 | 3/2018 | Cantrell et al. | |
| 2018/0325347 | A1 | 11/2018 | Cantrell et al. | |
| 2020/0108421 | A1 | 4/2020 | Licata et al. | |
| 2021/0030212 | A1 | 2/2021 | Chen | |
| 2023/0056546 | A1 | 2/2023 | Licata | |

FOREIGN PATENT DOCUMENTS

| | | | |
|---|---|---|---|
| AU | 2016244318 | B2 | 11/2016 |
| AU | 2018236823 | A1 | 10/2018 |
| AU | 2018236823 | B2 | 10/2018 |
| CA | 2768761 | A1 | 10/2010 |
| CN | 1387414 | A | 12/2002 |
| CN | 101366619 | A | 2/2009 |
| CN | 102458209 | A | 5/2012 |
| CN | 102458209 | B | 9/2014 |
| CN | 104274139 | A | 1/2015 |
| DE | 202004017681 | U1 | 9/2005 |
| EP | 0372342 | A1 | 6/1990 |
| EP | 2429370 | A1 | 3/2012 |
| GB | 1227798 | A | 4/1971 |
| JP | 6560409 | B2 | 8/2019 |
| KR | 10-0597324 | B1 | 7/2006 |
| WO | 2010124149 | A1 | 10/2010 |
| WO | 2013123506 | A1 | 8/2013 |
| WO | 2023023389 | A1 | 2/2023 |

OTHER PUBLICATIONS

"English Machine Translation EP 1421893".
"Examination Report No. 1 received for Australian Patent Application Serial No. 2010238773 dated Sep. 18, 2015, 3 pages.", 3 pages.
"Examination Report Received for CA Application No. 2,768,761, mailed on Oct. 22, 2018, 3 pages", Oct. 22, 2018, 3.
"Extended European Search Report Received for European Application No. 09818631.5, mailed on Dec. 20, 2017, 10 pages".
"Extended European Search Report Received for European Application No. 10767806.2, mailed on Dec. 15, 2017.", 9 pages.
"Final Office Action Received for U.S. Appl. No. 15/043,918, Mailed on Apr. 11, 2018, 16 pages."
"Final Office Action received for U.S. Appl. No. 16/042,824 on Feb. 24, 2020, 15 Pages."
"Final Office Action Received for U.S. Appl. No. 12/765,838 mailed on Nov. 3, 2017, 10 pages".
"Final Office Action received for U.S. Appl. No. 12/765,838 dated Aug. 22, 2014, 12 pages."
"Final Rejection Received for U.S. Appl. No. 15/695,888 mailed on Mar. 18, 2020, 17 pages".
"First Examination Report Received for Australian Application No. 2016244318, Mailed on Jan. 15, 2018."
"First Examination Report Received for Australian Application No. 2016250417, Mailed on Jan. 15, 2018, 3 pages".
"First Examiner report received for Application No. 2018236823, issued Aug. 5, 2019, 2 pages".
"First Office Action received for Chinese Patent Application Serial No. 201410412324.6 dated Jul. 20, 2016, 24 pages (including English Translation).", 24 pages.
"International Preliminary Report on Patentability received for PCT Application Serial No. PCT/US2010/032137 issued Oct. 25, 2011, 9 pages."
"International Preliminary Report on Patentability received for PCT Application Serial No. PCT/US2013/026705 dated Aug. 19, 2014, 10 pages.", 10 pages.
"International Search Report and Written Opinion of International Patent Application No. PCT/US2013/026705, mailed Jun. 3, 2013".
"Non Final Office Action Received For U.S. Appl. No. 15/695,888 mailed on Jan. 2, 2019, 25 Pages."
"Non Final Office Action Received For U.S. Appl. No. 16/042,824, mailed on Aug. 22, 2019, 24 Pages."
"Non-Final Office Action Received for U.S. Appl. No. 15/043,918, Mailed on Sep. 18, 2017, 9 pages".
"Non-Final Office Action received for U.S. Appl. No. 12/765,838 dated Oct. 31, 2013, 12 pages."
"Non-Final Office Action received for U.S. Appl. No. 14/379,190 dated Apr. 18, 2016, 13 pages."
"Non-Final Office Action received for U.S. Appl. No. 14/379,190 dated Oct. 7, 2016, 16 pages."
"Notice of Acceptance Received for Australian application No. 2018236823, Accepted on Jul. 29, 2020".
"Notice of Allowance Received for CA Application No. 2,768,761 mailed on Mar. 14, 2018".
"Notice of Allowance received for CN Application No. 201080028126.X mailed Jun. 5, 2014".
"Notice of Allowance Received for U.S. Appl. No. 12/765,838, Mailed on Mar. 27, 2018, 8 Pages."
"Notice of Allowance Received for U.S. Appl. No. 14/379,190, mailed on Apr. 28, 2017."
"Notice of Allowance Received for U.S. Appl. No. 15/043,918, Mailed on Jul. 5, 2018, 8 Pages."

(56) References Cited

OTHER PUBLICATIONS

"Notice of Allowance Received for U.S. Appl. No. 15/695,888, mailed on Jun. 26, 2020."
"Notice of Allowance Received for U.S. Appl. No. 16/042,824, mailed on Jul. 14, 2020."
"Office action received for Canadian Application No. 2,768,761 mailed on Jul. 4, 2017".
"Office action received for Canadian Application Serial No. 2,768,761 mailed on Feb. 15, 2016, 3 pages."
"Office Action received for CN Application 201080028126.X, Mailed Aug. 7, 2013".
"Second Examination Report Received for Australian Application No. 2016250417, Mailed on Aug. 24, 2018, 4 Pages."
"Written Opinion of International Patent Application No. PCT/US2010/032137 mailed Jun. 21, 2010, 9 pages".
"Written Opinion of the International Search Authority for PCT/US2009/059600, mailed Feb. 22, 2010, 8 pages".
Non Final Office Action Received For U.S. Appl. No. 15/695,888 mailed on Aug. 7, 2019, 9 Pages.
"Non Final Office Action Received for U.S. Appl. No. 16/180,986, mailed on May 15, 2019, 12 Pages".
"Communication Pursuant to Article 94(3) EPC Received for European Patent Office Application No. 10767806.2, Mailed On May 25, 2021."
"Communication Pursuant to Article 94(3) EPC Received for European Patent Office Application No. 10767806.2, Mailed On Jul. 4, 2023."
"International Search Report and Written Opinion for International Application No. PCT/US2022/041010, Search completed on Dec. 5, 2022, Mailed on Dec. 6, 2022."
"Non-Final Office Action received for U.S. Appl. No. 17/891,915, Mailed on Aug. 13, 2024".

* cited by examiner

TRANSVERSE SECTION

FIG. 4A
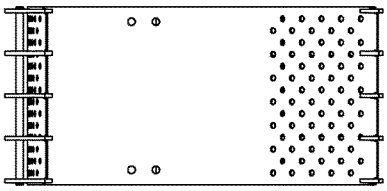
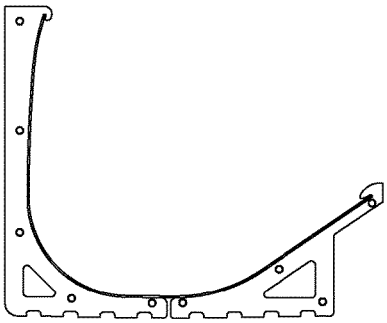
FIG. 4B
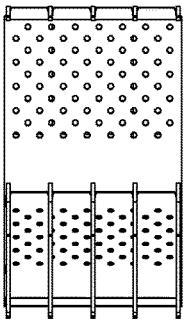
FIG. 4C
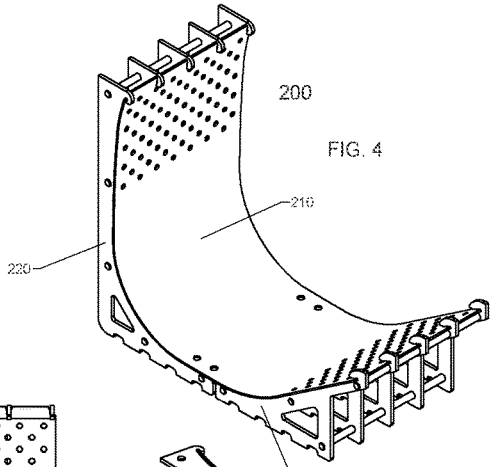
FIG. 4
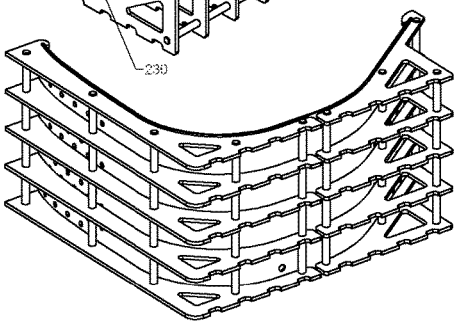
FIG. 4D

FLUID FLOW STRUCTURE AND METHOD OF USE FOR CONTINUOUS MOTION WASHING MACHINE

CROSS-REFERENCE TO RELATED APPLICATIONS

This application is a continuation application of each of the following:

U.S. patent application Ser. No. 16/042,824, filed Jul. 23, 2018, which is a divisional application of U.S. patent application Ser. No. 12/765,838, filed Apr. 22, 2010, now U.S. Pat. No. 10,028,636, which claims priority pursuant to 35 U.S.C. 119(e) to U.S. Provisional Patent Application Ser. No. 61/171,752 filed Apr. 22, 2009, 61/177,105 filed May 11, 2009, 61/227,686 filed Jul. 22, 2009, 61/231,987 filed Aug. 6, 2009, 61/233,811 filed Aug. 13, 2009, 61/236,801 filed Aug. 25, 2009, 61/255,083 filed Oct. 26, 2009, and 61/266,430 filed Dec. 3, 2009, the entire disclosures of which are incorporated herein by reference; and U.S. patent application Ser. No. 15/695,888, filed Sep. 5, 2017, now U.S. Pat. No. 10,820,776, which is a continuation application of Ser. No. 14/379,190, filed Aug. 15, 2014, now U.S. Pat. No. 9,750,388, which:

is a continuation-in-part of U.S. Non-application Ser. No. 12/765,838 (see above); and claims priority to Patent Cooperation Treaty Application No. PCT/US2013/026705 filed Feb. 19, 2013, which claims priority to U.S. Provisional Patent Application Ser. No. 61/600,581, filed Feb. 17, 2012, the entire disclosure of which is incorporated herein by reference.

FIELD OF THE INVENTION

The present invention relates to a washing machine, a fluid flow structure (such as a removable wash tank insert and/or a fluid-flow plate/guide structure) of a washing machine and methods of use of a fluid flow structure for a continuous motion washing machine (such as those used to wash items such as pots and pans and other ware, produce, etc.).

BACKGROUND OF THE INVENTION

Continuous motion washing machines, such as pot and pan washing machines of the type used in restaurants, institutions and other eating facilities, often involve a large wash tank or basin in which fluid is circulated to provide a rolling wash action for the pots, pans or other items being washed. One such machine is described in U.S. Pat. No. 4,773,436 issued to Cantrell et al., the specification of which is incorporated herein by reference. The machine of Cantrell includes a wash tank with multiple jets evenly spaced apart at an elevated position along the rear wall of the wash tank. The tank is filled with water (or other suitable wash fluid) to a level above the position of the jets. Pots and pans are placed in the wash tank, and a pump is activated to draw fluid from within the wash tank and direct it through the jets to create a jet stream. Each jet directs its jet stream toward the bottom wall of the wash tank, the bottom wall then deflects the jet stream upward and towards the front wall of the tank. The front wall then deflects the upward moving jet stream towards the rear wall of the tank, and the rear wall deflects the jet stream downward and back towards the front wall along the bottom wall. The combination of deflections of the jet stream from the bottom, front and rear walls provides a rolling washing action within the wash tank.

The basic components of the wash tank of the pot and pan washing machine of the prior art are shown in FIG. 1. Wash tank 10 includes end walls 12 and 14, rear side wall 16, front side wall 18 and bottom wall 19. A pump can be attached to either end wall; in the embodiment shown in FIG. 1, pump 50 is attached to right end wall 14. An impeller located within pump 50 is driven by electric motor 56. The impeller draws fluid into pump inlet 52 through an intake port (not shown) located in end wall 14. The fluid is then discharged from the pump through pump outlet 54 and into outlet manifold 60. Outlet manifold 60 includes a ninety degree turn, and several other turns, to direct the fluid across the back side of rear wall 16 and out jet nozzles 20 ("flow directional openings") which are protruding through and extending from rear wall 16. The intake port associated with pump inlet 52 is covered by perforated (holes, voids, mesh, etc.) intake manifold 30. Intake manifold 30 includes handle 36 and is removably supported within wash tank 10 for easy cleaning. Intake manifold 30 fits tightly between outer runner 32 and inner runner 34, each of which extends vertically from bottom wall 19. Heating element 40 is positioned between intake manifold 30 and end wall 14 for its protection and to maximize the use of space.

Although the prior art pot and pan washing machine disclosed in U.S. Pat. No. 4,773,436 provides an exceptional wash action, many of the components discussed above hinder the overall efficiency and performance of the machine. The inventions disclosed in U.S. application Ser. Nos. 09/947,484; 09/947,485; and Ser. No. 10/744,666, the entire disclosures of which are incorporated herein by reference, provide components that greatly increase the overall efficiency and performance of the machine, including improvements to the intake and discharge manifolds, jets, pump and system assembly methods. Nevertheless, it is often difficult to maintain suitable lifting action within the front portion of the wash tank to maintain the washing action, particularly when large, generally flat items are located toward the bottom front of the generally rectangular wash tank. Such items will tend to "stick" toward the bottom of the tank by the initial downward jet stream. The downward force from the jet stream can create a pinning action of certain types of items and these items will not roll and rotate with the wash action, resulting in these items remaining substantially soiled. In addition, as items roll and rotate within the wash tank, they often impact (with considerable force) the generally rigid steel walls of the wash tank. Such impacts result in significant noise during a wash cycle and also create unsightly and potentially harmful dents in the walls of the wash tank. In particular, dents in the bottom wall of the wash tank tend to pool water when the wash tank is drained, creating potentially unsanitary conditions. While prior art systems have been developed in which the bottom wall of the wash tank is curved (or barrel-shaped) to reduce or prevent such pinning, construction of wash tanks with such shapes is much more time consuming and expensive than construction of a generally rectangular wash tank. Moreover, it is often preferred to utilize a generally rectangular wash tank for maximizing the usable washing area within the wash tank, particularly for larger, longer items such as sheet pans. Furthermore, the generally rigid, metal walls of such curved tanks still experience significant impacts and noise during a wash cycle. Therefore, it would be beneficial to provide a washing machine, or component(s) thereof, that provide a wash action(s) that is suitable for washing a large variety of items of varying sizes, shapes and weights. It would further be beneficial to provide a washing machine, or component(s) thereof, that is cost-efficient to construct and/or that reduces impacts, noise or other vibrations action on the walls of the wash tank.

SUMMARY OF THE INVENTION

An object of the instant invention is to provide a washing machine, or component(s) thereof, that provide a wash action(s) that is suitable for washing a large variety of items of varying sizes, shapes and weights. Another object of the instant invention is to provide a washing machine, or component(s) thereof, that is cost-efficient to construct and/or that reduces impacts, noise or other vibrations action on the walls of the wash tank.

The instant invention includes washing machine and/or a fluid flow structure for a washing machine wash tank. The instant inventions provide improvements to or for use with pot and pan or other item washing machines, such as those described in any of U.S. Pat. No. 4,773,436, U.S. application Ser. Nos. 09/947,484, 09/947,485, 10/744,666 and 12/430,724, or International application Ser. No. PCT/US09/59600 (the entire disclosures of which are incorporated herein by reference). It will be appreciated that other washing machine structures, or various combinations of washing machine structures or components thereof may be utilized in connection with the instant invention without departing from the spirit and scope of the instant invention.

The washing machine of, or in association with, the instant invention includes a generally rectangular wash tank including a bottom wall, two side walls and two end walls extending upwardly from said bottom wall. In a preferred embodiment, the side walls are longer than the end walls. The wash tank further includes at least one flow directional opening in at least one of the walls. In a preferred embodiment, the wash tank includes a plurality of flow directional openings positioned along one of the side walls of the wash tank.

A fluid flow structure is located within said wash tank, which includes a fluid flow guide surface, and a support for said guide surface. The guide surface includes at least one region contoured inconsistently from the contour of at least one corresponding wall of the washing machine wash tank. In a preferred embodiment, the contour of the guide surface is generally curved. The contour of the guide surface aids in reducing and/or preventing the pinning of items that often occurs in rectangular wash tanks of the prior art. The support for the guide surface creates a gap between said guide surface and at least one wall of the washing machine wash tank. The fluid flow guide surface defines a washing area within the wash tank that is located generally opposite of the gap with respect to said fluid flow guide surface. The guide surface, support and/or associated gap at least partially isolates impacts, noise or other vibrations acting on the guide surface from acting on the walls of the washing machine wash tank.

In a preferred embodiment, the fluid flow guide surface is capable of alternatively being inserted into and removed entirely from the washing machine wash tank such that a circulating wash action will be created in the washing machine wash tank whether said guide surface is inserted into or removed from the washing machine wash tank. In this manner, the generally rectangular wash tank of the washing machine may be utilized with the fluid flow guide surface removed to wash large-sized items such as sheet pans. In one such embodiment, sheet pans, or other items are placed in a rack within the wash tank, such that the items being washed will have fluid circulating around them, but will not also roll within the wash action created within the wash tank. This provides a preferred cleaning action due to the difficulty in rolling larger items. When smaller items, such as pots, pans, produce, etc., are to be washed, the fluid flow guide surface is reinserted into the wash tank.

In other preferred embodiments, the support is also removable from the wash tank. In some embodiments the flow guide surface and/or the support are capable of removal without the use of any tools. This allows for quick and easy insertion of the guide surface and/or support depending upon varying washing needs.

In some embodiments of the instant invention, the fluid flow guide surface and/or the support is generally flexible. In a preferred embodiment, the fluid flow guide surface and/or the support is made of a generally flexible, non-metallic material. The flexible fluid flow guide surface and/or the flexible support, provides for flexible motion of the guide surface (and/or support) that is independent of the walls of the wash tank. Thus, the guide surface can flex to absorb impacts or other vibrations before they are imparted upon the generally nonflexible (rigid) walls of the wash tank. This flexible motion, at least partially, isolates impacts, noise or other vibrations from acting on the walls of the wash tank.

In some embodiments, the support comprises a plurality of interconnected ribs that is placed within the wash tank. The ribs are supported by the bottom wall of the wash tank and may additionally be supported by one or more of the side walls of the tank. The ribs are not mechanically affixed to the walls of the wash tank, but is instead support through gravity, friction or some other form of non-attachable connection and which does not require any tools for removal. In preferred embodiments, a plurality of separate sections of interconnected ribs are utilized together in a single wash tank. In a preferred embodiment, each separate section includes a separate fluid flow guide surface that corresponds in length to the length of the section. The plurality of sections may fill the entire wash tank, or just a portion thereof, leaving such portion with the generally rectangular shape of the wash tank. This allows the portion without any section of ribs to be used for washing larger items, such as sheet pans. In a preferred embodiment, the combined length of the sections of ribs within the wash tank are sized to leave one or more voids between adjacent sections. This allows for a divider member to be at least primarily held in place between the two adjacent sections. It will be appreciated that other indexing structures, such as channels or tabs along the walls of the wash tank, may be utilized to further support the divider members, particularly toward the top of the wash tank.

In some embodiments of the instant invention, the fluid flow guide surface includes openings for allowing at least a portion of fluid flow directed from a flow directional opening to pass through the fluid flow guide surface. In some such embodiments, the fluid flow passes from a washing area defined by the fluid flow guide surface into the gap created by the support. In other embodiments, the fluid flow passes through the fluid flow guide surface into the washing area defined by said fluid flow guide surface and opposite the gap.

In one preferred embodiment, at least a portion of said fluid flow guide surface is generally horizontally orientated within the wash tank to create the circulating wash action in the washing machine wash tank about a generally horizontal axis of the wash tank. Such an embodiment is particularly useful for washing machines in which a rolling wash action is intended to be created about the horizontal axis of the wash tank. In an other embodiment, the fluid flow guide surface is generally vertically orientated within the wash tank to create the circulating wash action in the washing machine wash tank about a generally vertical axis of the wash tank. Such an embodiment is particularly useful for washing machines in which the rolling wash action is intended to be created about the vertical axis of the wash tank.

In one embodiment at least a portion of the gap created by the support includes a void that associates with a pumping system intake of the washing machine. The void acts as a manifold to create a flow a fluid generally through the void and into the intake of the machine.

Other embodiments of the invention includes a method of washing items in a continuous motion washing machine, the washing machine including a plurality of flow directional openings each supplying a jet stream of fluid within the washing machine, each jet stream deflecting from at least one wall of or from at least a portion of a removable flow guide structure positioned within the washing machine to provide a washing action, said method comprising the steps of:

isolating a portion of the washing machine by placing at least one member between two of said flow directional openings such that the member divides the washing action within said washing machine;

holding the member within a void created between two adjacent flow guide structures within said washing machine; and capturing at least a substantial portion of the jet stream from at least one of the plurality of flow directional openings within said isolated portion of the washing machine while at least substantially maintaining the jet stream deflection of the washing machine to provide a washing action within said isolated portion of the washing machine.

In one preferred embodiment of the above method said washing machine is a pot and pan washing machine.

Another embodiment of the invention includes a method of washing items in a continuous motion washing machine, the washing machine including at least one flow directional opening supplying a jet stream of fluid within the washing machine, the jet stream deflecting from at least one wall of or from at least a portion of a removable flow guide structure positioned within the washing machine to provide a washing action, said method comprising the steps of:

locating a fluid flow guide surface within the washing machine, wherein at least one region of the surface is contoured inconsistently from the contour of at least one corresponding wall of the washing machine wash tank; and introducing the jet stream within a washing area within said wash tank defined by said fluid flow guide surface, said washing area being generally opposite a gap created between said fluid flow guide surface and at least one wall of the washing machine.

In some preferred embodiments this method further comprises the steps of:

locating an item within said washing area; and orientating an axis of said item generally perpendicular to the jet stream.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

FIGS. 4, 4A, 4B, 4C and 4D are various views of an insert structure of the type shown in FIG. 3. FIG. 4 is a top side perspective view of the fluid-flow plate insert structure. FIG. 4A is a top plan view of the fluid-flow plate insert structure of FIG. 4. FIG. 4B is a side elevation view of the fluid-flow plate insert structure of FIG. 4. FIG. 4C is a rear elevation view of the fluid-flow plate insert structure of FIG. 4. FIG. 4D is a frontal bottom perspective view of the fluid-flow plate insert structure of FIG. 4.

DETAILED DESCRIPTION OF A PREFERRED EMBODIMENT

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
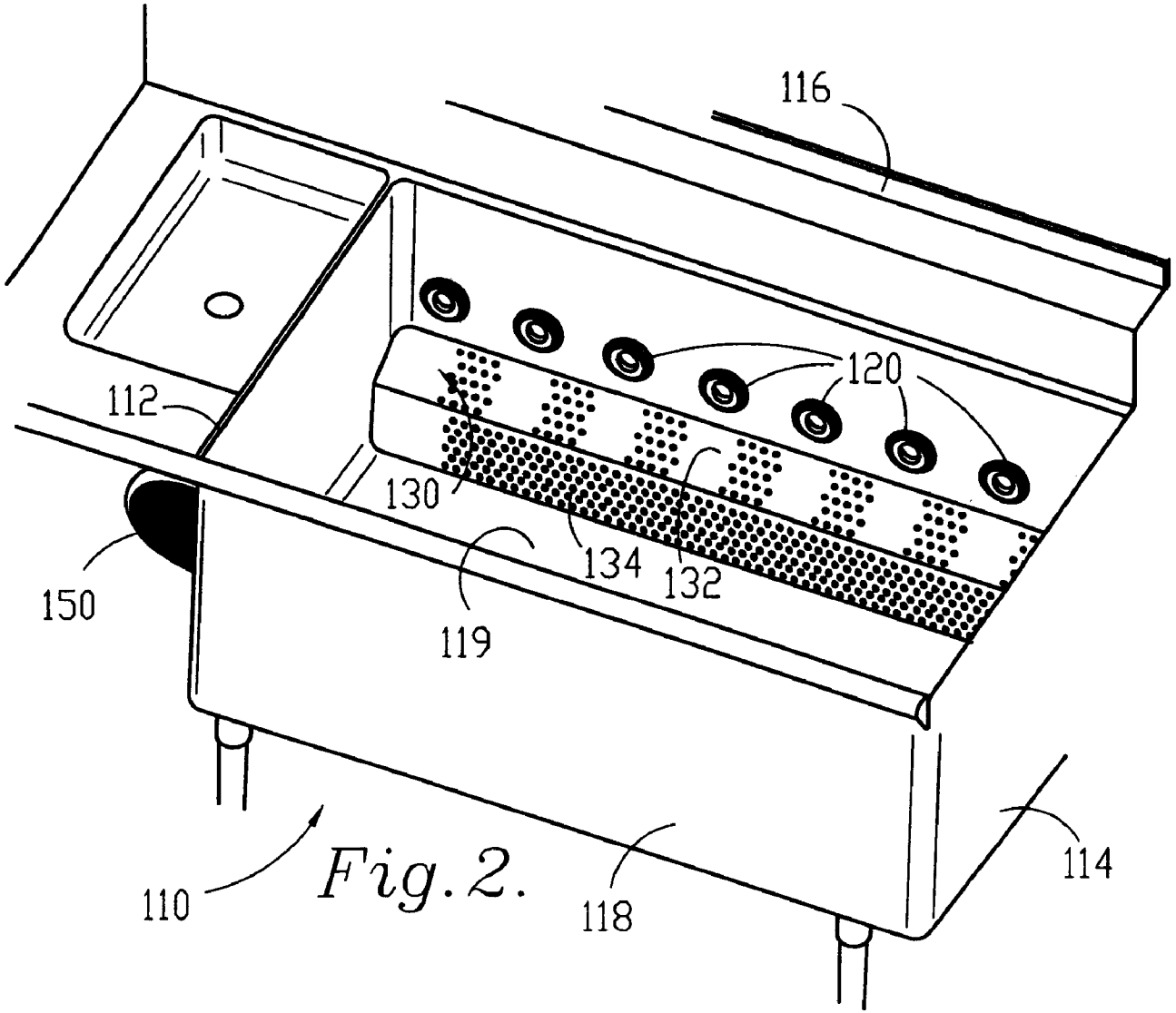
FIG. 2 is a fragmentary perspective view from above of another pot and pan washing machine of the prior art including a generally linear intake manifold, in which embodiments of the instant invention may be incorporated.

Referring to FIG. 2, an embodiment of the instant invention is shown. The generally rectangular wash tank/basin is constructed in essentially the same manner as the wash tanks of the prior art. Wash tank 110 includes left end wall 112, right end wall 114, rear side wall 116, front side wall 118 and bottom wall 119 constructed in the same or similar manner, and of the same or similar materials as the wash tank of the prior art. Pump 150 is attached to left end wall 112 of the embodiment shown, Nevertheless, pump 150 can be attached to either left end wall 112 or right end wall 114 of wash tank 110. In addition it is understood that pump 150 could be attached to any other wall of the wash tank, or otherwise located separate from the wash tank and connected to the interior of the wash tank via a hose or other piping. Flush mounted jet nozzles 120 are mounted along rear wall 116 equally spaced apart from one another. Intake manifold 130 is mounted within wash tank 110 along the bottom portion of rear wall 116, below nozzles 120. Intake manifold 130 includes an upper portion 132 extending outwardly from rear wall 116 toward front wall 118, and lower portion 134 extending from the front end of upper portion 132. In a preferred embodiment, the upper portion of intake manifold 130 is angled downward from rear wall 116. The downward angle of the upper portion of intake manifold 130 corresponds to the downward angle of jet nozzle 120 which directs a fluid path toward the front portion of bottom wall 119, creating a circulating wash action in the wash tank about a generally horizontal axis of the wash tank. Portions of the intake manifold are perforated to allow fluid to be drawn into manifold 130 by the pump.

Figure 5:
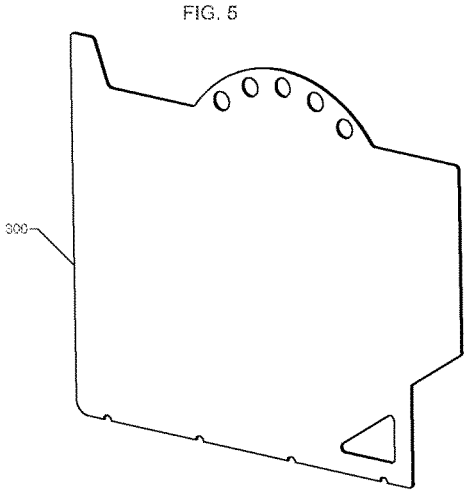
FIG. 5 is a side perspective view of the divider shown in FIG. 3.
Figure 3:
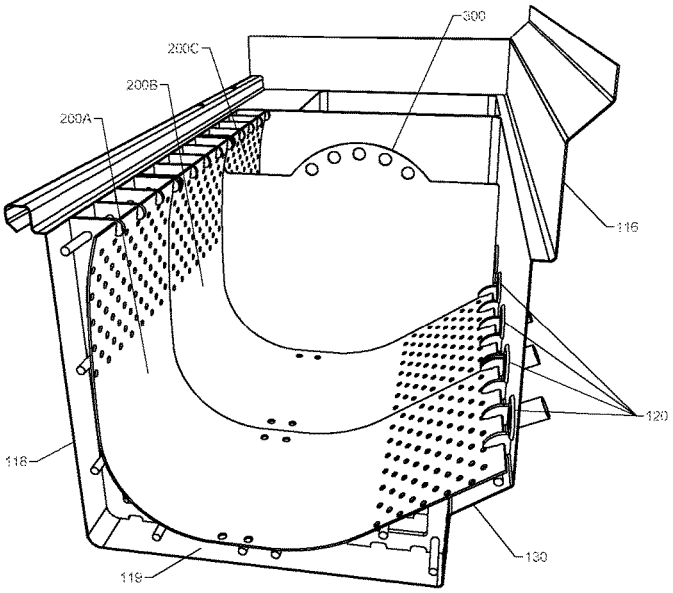
FIG. 3 is a side perspective partial sectional view of several fluid-flow plate insert structures of an embodiment of the instant invention positioned within the wash tank of a pot and pan washing machine of FIG. 2 and including a divider member between two adjacent sections of insert structures.

Referring to FIG. 3, an embodiment of the instant invention is shown that includes three sections (200*a*, 200*b* and 200*c*) of fluid-flow plate insert structures (illustrated generally in FIGS. 4, 4A, 4B, 4C and 4D) of an embodiment of the invention removably insertable within wash tank 110. Divider member 300 (shown generally in FIG. 5) is positioned in a void or slot between adjacent sections 200*b* and 200*c*. The fluid-flow plate insert structures shown in FIGS. 3 and 4 are generally horizontally orientated within wash tank 110 to aid in or create a circulating wash action about a generally horizontal axis of the wash tank.

FIG. 4 is a top side perspective view of a fluid-flow plate insert structure 200 generally of the type shown in FIG. 3. FIG. 4A is a top plan view of the fluid-flow plate insert structure of FIG. 4. FIG. 4B is a side elevation view of the fluid-flow plate insert structure of FIG. 4. FIG. 4C is a rear elevation view of the fluid-flow plate insert structure of FIG. 4. FIG. 4D is a frontal bottom perspective view of the fluid-flow plate insert structure of FIG. 4.

Figure 6:
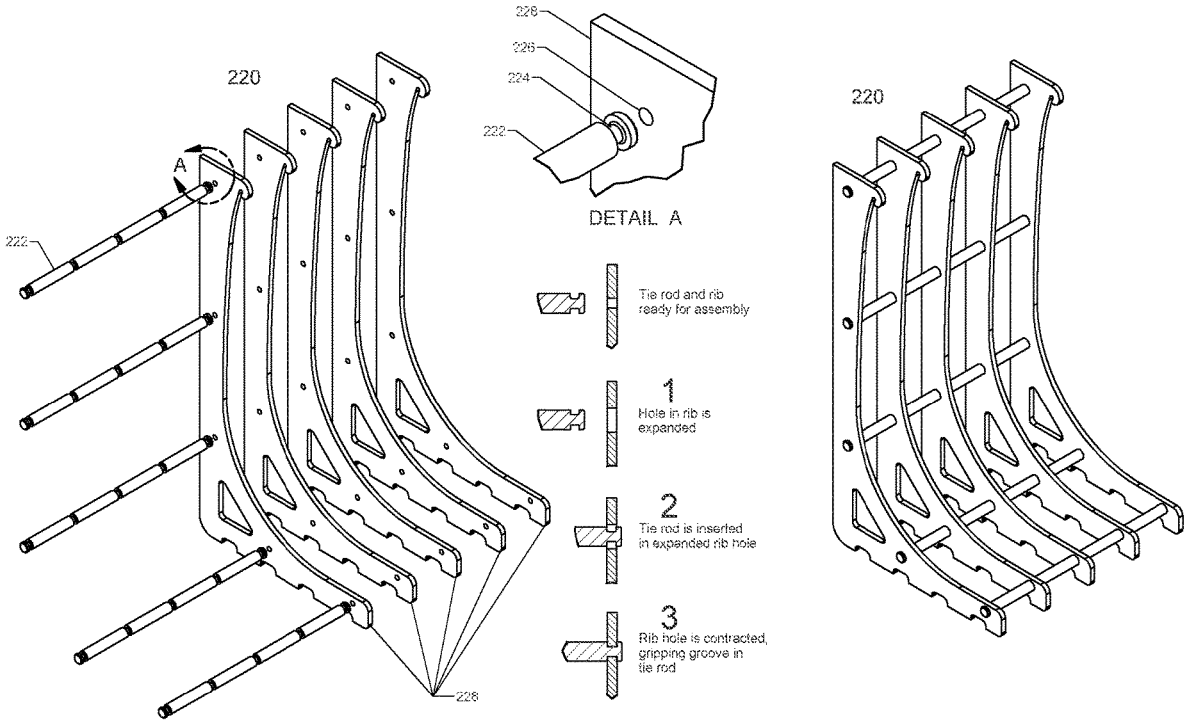
FIG. 6 include perspective views and detailed sectional views illustrating the assembly of an embodiment of a front support structure of the insert structure of FIG. 4.

As is discussed in more detail below, the fluid-flow plate insert structure(s) shown in FIGS. 3 (200*a*, 200*b* and 200*c*) and 4 (200) includes two separate support structures, front support 220 and rear support 230 that are each made up of a plurality of ribs 228, and a curved plate (fluid flow guide surface) 210 that rests on top of the support structures. In one embodiment the ribs are connected together by a plurality of ¼ inch diameter rods that run through holes bored in each rib. A cylindrical spacer is positioned on the rod between each rib and the ribs are held together by bolts on each end of the rod. In another embodiment, as is shown in FIG. 6, the ribs are connected together by a plurality of ½ inch diameter rods 222 that run through holes 226 bored in each rib 228. The rods 222 include annular grooves 224 at spaced intervals along the rods' surface. The diameter of the holes in the ribs through which the rod runs are slightly smaller than the diameter of the ½ inch rod. The material of the ribs is slightly flexible and/or malleable to allow the rib to be slid onto the rod until the rib snaps or engages into the grove and is held tightly in place. In such an embodiment, the spacers and bolts are not needed to connect the ribs together. It will be appreciated that alternative method of connecting ribs of a section may be utilized without departing from the spirit and scope of the instant invention.

Although the fluid flow guide surfaces and support structures in the embodiments shown and described herein are separable from one another, it will be appreciated that embodiments in which the fluid flow guide surface is integral with the support structure are included within the scope of the instant invention. For example, in one such embodiment, ribs similar to those discussed above with respect to FIGS. 3-6 are connected together without the inclusion of a separate plate 210. In such an embodiment, the top curved surface of the ribs themselves act as the fluid flow guide surface. In some embodiments, the ribs include separate front and rear structures as are discussed above. In other embodiments, the front and rear structures are integral with one another. Other embodiments will be readily apparent to those of ordinary skill in the art.

As is discussed above, the fluid-flow plate 200 of FIG. 4 includes a plurality of ribs 228 (including front and rear structures 220 and 230). The ribs are spaced at regular intervals from one another and are fixedly attached to the next adjacent rib. As shown in FIG. 4A, the ribs are arranged such that the fluid-flow plate is generally rectangular in shape when viewed from the top. The fluid-flow plate sections of FIGS. 3 (200*a*, 200*b* and 200*c*) are combined together to extend in length from one end wall to the opposite end wall of the wash tank (i.e. 112 to 114). The fluid-flow plate sections of FIGS. 3 (200*a*, 200*b* and 200*c*), when viewed from the top, also are combined together to extend from the front to the back of the wash tank. Notwithstanding, it will be appreciated that fluid-flow plate structures that do not extend from end to end and/or from front to back of the wash tank are within the spirit and scope of the instant invention. For example, in one preferred embodiment, only sections 200*a* and 200*b* are included in wash tank 100 shown in FIG. 3, leaving the area in which 200*c* is located to merely include the generally rectangular shape of wash tank 110. This allows items such as a rack of sheet pans to be located in the area for cleaning without the use of insert section 200*c*, such that the maximum area of the rectangular wash tank may be utilized.

As shown in FIG. 4B, when viewed from the side, each rib includes a curve along the top of the rib such that the rib is much higher at the front (220) of the tank than at the back/rear (230) of the tank. Furthermore, the lowest point of the curve is generally at the middle of the tank, rather than at the front or back. Arranged with a plurality of ribs in parallel, each rib with substantially similar or identical curves, the fluid-flow guide surface 210 positioned on the ribs directs a portion of the fluid along the curve of the combined insert structure 200. The fluid is directed downward along the curve along the lower back portion of the wash tank. Once the fluid reaches the lowest point of the curve of the structure, the fluid is directed upward at the front portion of the wash tank. Some fluid also flows between the ribs in addition to along the curve of the tops of the structure. Thus, the fluid-flow plate provides a more efficient and quieter rolling action within the wash tank and helps to prevent pans and other objects from sticking to and/or striking the bottom of the wash tank.

The fluid-flow plate 200 shown in FIGS. 3 and 4 may be made of any material. In some embodiments, the ribs of the fluid-flow plate and/or guide surface are comprised of a stainless steel or other non-corrosive metal. Preferably, the ribs and guide surface include a material that partially is flexible and absorbs the impact of the pans and/or other objects being washed, such that blemishes ("dings") and noise are reduced. As discussed above, a vibration damping material, such as QUIET STEEL (available from Material Sciences Corporation), nylon, plastic, rubber coating, laminate, or other suitable material may be used. In some embodiments the curved plate and/or the ribs are flexible, in other embodiments the curved plate and/or ribs are rigid.

The fluid-flow plate insert 200 shown in FIG. 4 may be used with any size wash tank. As discussed above, multiple sections of inserts may be combined together to span the entire length of the wash tank, if desired. In addition, varying widths (from front to back) of the fluid flow guide surface 210 may be positioned within supports 220 and 230 to accommodate varying widths of wash tanks. In such manner, front support 220 and rear support 230 will be spaced further apart from one another for larger widths, and closer together to one another for smaller widths.

As is discussed above, the fluid-flow plate 200 includes a curved plate (fluid flow guide surface) 210 that rests on the tops of the two support structures. Each rib in each support structure includes a tab at the high end to receive an edge of the curved plate and maintain its position with respect to the support structure. When viewed from a side, such as shown in FIG. 4B, the curved plate is much higher at the front of the tank and curves downward toward the bottom of the tank at a location between the front and back of the tank. The curved plate curves upward again toward the rear of the tank, as shown in FIG. 4B. The curve is mostly vertical at the front of the tank and between vertical and horizontal at the back of the tank, as shown in FIG. 4B.

The curved plate includes a plurality of apertures toward the front and rear of the tank, as shown in FIG. 19(*e*). In some embodiments, the apertures are large enough, and spaced appropriately, such that a user can insert one or more finger to aid in the adjustment or removal of the curved plate within the tank. In other embodiments, the holes also help to accommodate surge in the wash level during operation of the machine. In still other embodiments, holes in the curved plate allow the fluid flow from the flow directional openings to be directed through the curved plate either into the wash area defined by the plate or into the gap created between the curved plate 210 and the walls of the wash tank by the support structure. In some embodiments, the rear apertures are sized and shaped to allow fluid to flow from the wash area through the apertures and into an intake manifold. In another embodiment, the pattern of apertures toward the rear portion of the curved plate are identical to that toward the front of the plate. In this manner, the insert of the instant invention may be easily assembled in either direction with no change in performance. In one such embodiment, the pattern includes both smaller apertures and larger apertures as are discussed above.

The fluid-flow plate 200 as shown in FIGS. 3 and 4 is a modular unit to accommodate different sized wash tanks. In the case of a wash tank with a longer length, front to back, the same support structures may be used by replacing the curved plate with a curved plate of longer length (front to back). In the case of a wash tank with a longer width, side end to side end, multiple support structures and curved plates are used side by side. In this manner, the fluid-flow plate as shown in FIGS. 3 and 4 can accommodate a large variety of wash tank sizes and configurations. The fluid-flow plate may be removed entirely from the wash tank and thus is compatible with other pot and pan washing systems.

In a preferred embodiment, the fluid-flow plate 200 shown in FIGS. 3 and 4 is inserted into the wash tank of a pot and pan washing machine by first placing the front support structure 220 in the bottom of the wash tank along the front wall of the wash tank and the back support structure 230 in the bottom of the wash tank along the rear wall of the wash tank. The curved plate 210, which originally is made of a generally flat material (such as a piece of sheet metal or plastic) is then inserted into the tabs at the high ends of the front and back support structures and curved to conform to the shape along the top surfaces of the support structures. The tension created by the curving of the plate causes the front and back support structures to be urged away from one another such that the front edge of the front support structure is pressed against the front wall of the wash tank and the rear edge of the rear support structure is pressed against the rear wall of the wash tank. This tension holds the fluid-flow plate in position within the wash tank. In alternative embodiments, the curved plate 210 is inserted into the support structures (220 and 230) prior to insertion of the fluid flow plate structure 200 into the wash tank.

In some embodiments the ribs of the front support structure are design to be able to overlap the ribs of the back support structure when installed in a wash tank. This occurs when the combined width (i.e. front to rear of a wash tank and/or fluid-flow plate) of the front and back support structures is greater than the width of the wash tank. In such embodiments, the ribs of the front support structure must be slightly offset from the ribs of the back support structure to account for the overlap. In use, the larger the width of the tank, the wider the curved plate. The wider curved plate causes the opposing ends of the front and back support structures to be urged further apart from one another thereby accommodating a wider wash tank. In a preferred embodiment the front and back/rear support structures are identical to each other. The only difference is the width of the curved plate that is inserted. The larger the width of the tank, the wider the curved plate. The wider curved plate causes the opposing ends of the front and back support structures to be urged further apart from one another thereby accommodating a wider wash tank.

Figure 1:
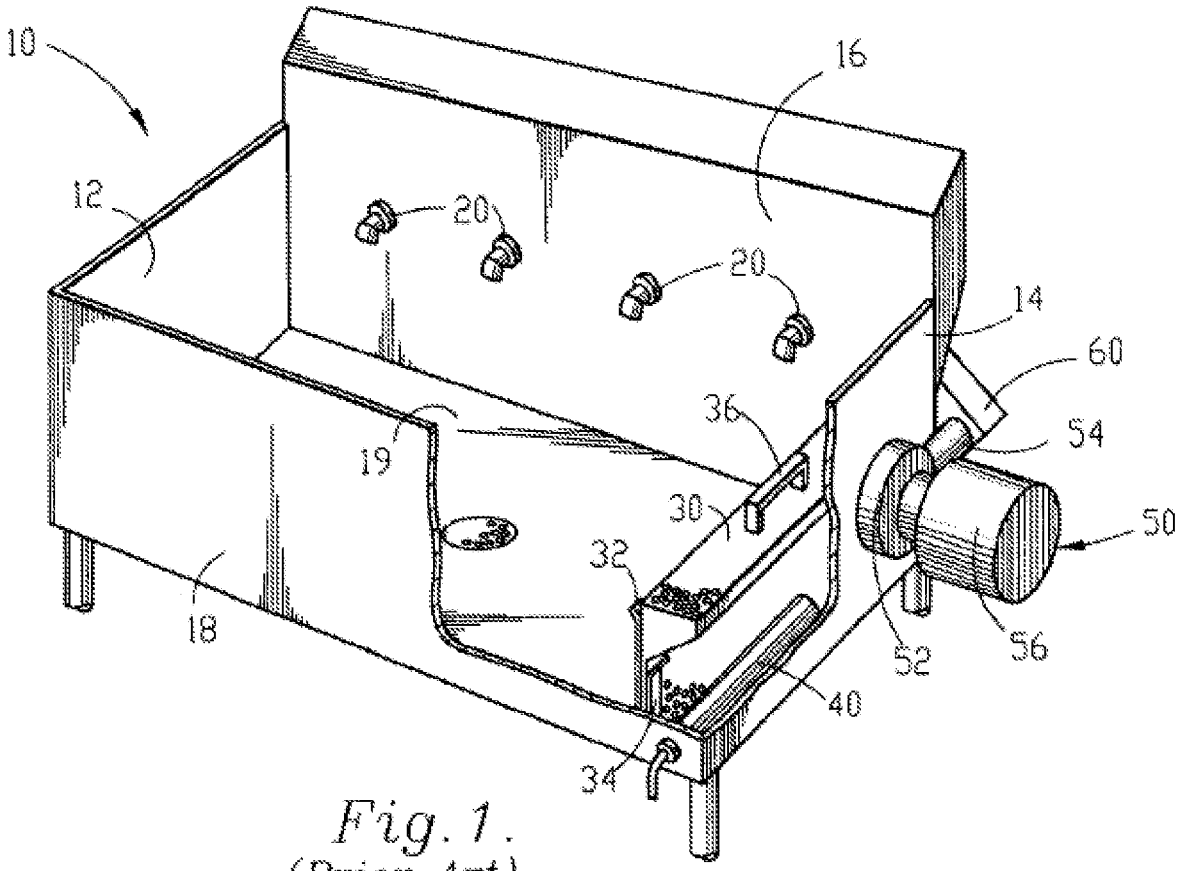
Fig. 1. (Prior Art)
FIG. 1 is a partial perspective view of a pot and pan washing machine of the instant invention and in which embodiments of the instant invention may be incorporated.

As is shown in FIG. 4B, the ribs of both the front and back support structures each include scallops along the edges of the ribs that are placed in contact with the bottom wall of the wash tank. In alternative embodiments, scallops may be included in other surfaces (i.e. along the bottom edge of both ribs and/or along the front edge of the front rib and/or along the rear edge of the rear rib). In addition, both ribs includes a number of holes or voids through the ribs. The scallops and holes/voids all act to cushion impacts from pots and pans and to reduce noise transmission. In a preferred embodiment, in which the fluid flow plate insert structure is utilized in connection with the wash tank 10 embodiment shown in FIG. 1, which includes an intake on the end wall of the wash tank, the holes/voids in the support structure allow fluid to flow freely through/around the ribs. In such embodiment, the holes/voids act as an intake manifold for the pumping system.

As is discussed above, the fluid flow plate structure 200 is a modular unit to accommodate different sized wash tanks. In the case of a wash tank with a longer width, front to back, the same support structures may be used by replacing the curved plate with a curved plate of longer length (front to back) as is discussed above. In the case of a wash tank with a longer length, side end to side end, multiple support structures and curved plates are used side by side. In this manner, the fluid-flow plate structure 200 can accommodate a large variety of wash tank sizes and configurations. The fluid-flow plate may be removed entirely from the wash tank and thus is compatible with other pot and pan washing systems.

In the embodiment shown in FIG. 3, three separate fluid-flow plate insert structures (200*a*, 200*b* and 200*c*) are utilized in a single wash tank. The three insert structures are placed side by side in the bottom of the wash tank in the manner described above. The combined length of the curved plates of the three insert structures is slightly less than the length (side end to side end) of the wash tank of the washing machine. This creates a slot or gap between the ends of adjoining insert structures and/or between an end of the insert structure(s) and the end wall of the wash tank. The dimension of the slot/gap/void is sized to accommodate a divider member, such as a metal or plastic member similar to that described in U.S. Pat. No. 7,523,757 the entire disclosure of which is incorporated herein by reference. The location of the slot/gap may be changed by the operator of the machine by changing the location of the three insert structures within the wash tank. In some embodiments, two of the insert structures are of equal length side to side as each other and are substantially longer than the third insert structure. This allows for a variety of different arrangements of the insert structures and the divider member within the wash tank to create a variety of isolated portions or areas within the wash tank. When not in use, the divider and gap can be positioned to be abutted against one of the end walls of the wash tank in the slot between the left end wall and the three insert structures. This results in a generally open wash tank arrangement (i.e. no isolated portions of the wash tank) and provides a convenient storage location for the divider member. It will be appreciated that the locations of the three inserts may be manipulated in a variety of different ways in addition to those shown and discussed here (for example, the shorter insert structure may be located in the middle of the two longer insert structures). In addition, it will be appreciated that the number of insert structures may either be increased or decreased to provide a variety of different arrangements within the wash tank. Further, it will be appreciated that the combined length of the curved plates of the insert structures may be manipulated to allow for multiple divider members within a single wash tank.

Figure 7:
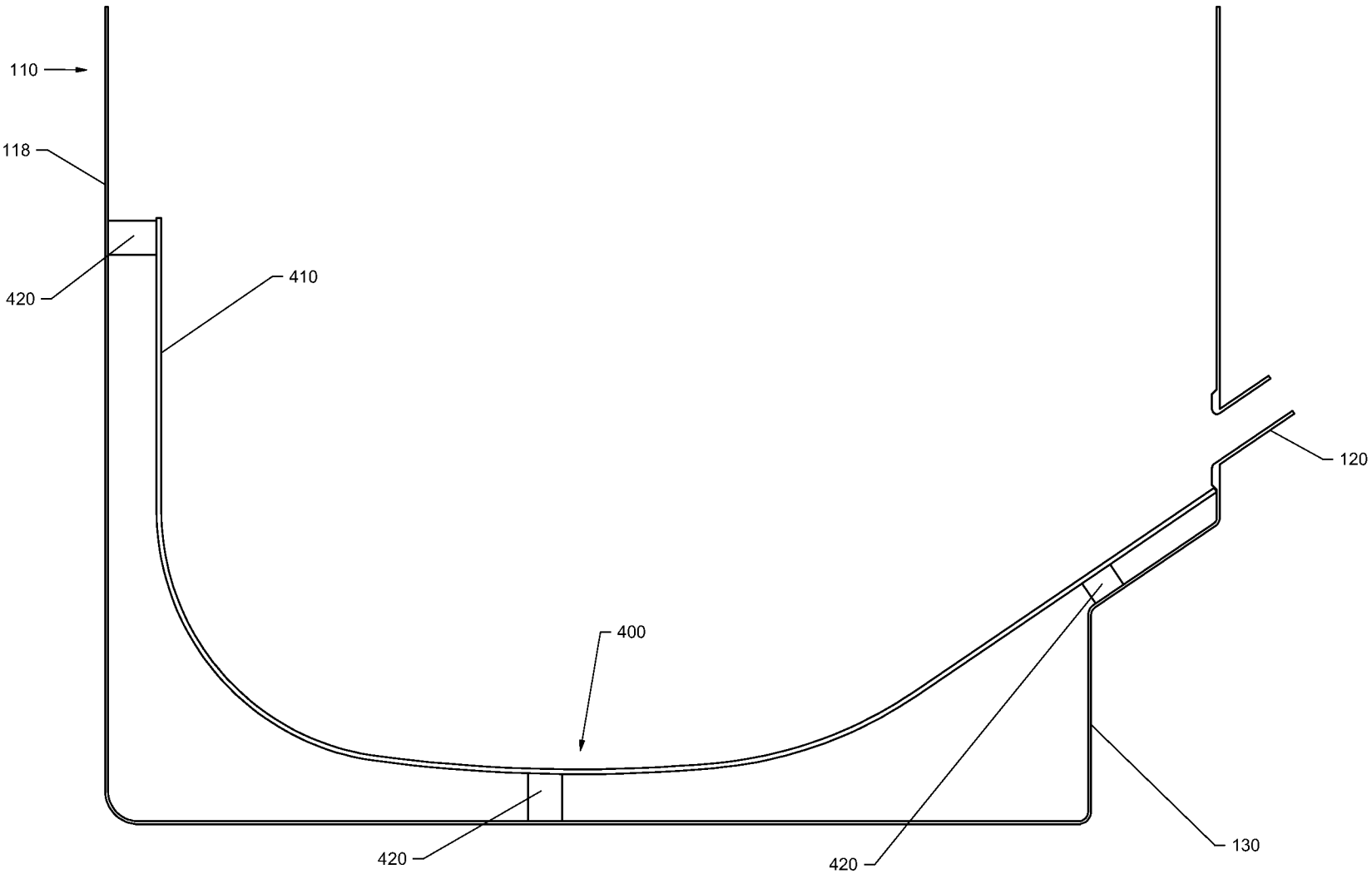
FIG. 7 is a side sectional view of another embodiment of a fluid-flow plate insert structure shown positioned within the wash tank of the pot and pan washing machine of FIG. 2.

Referring to FIG. 7 a side sectional view of another embodiment of a fluid-flow plate insert structure 400 is shown positioned within the wash tank of a pot and pan washing machine. In the embodiment shown in FIG. 7, the support structure for the curved plate 410 includes a plurality of bumpers 420 located within the wash tank to create spacing between the walls of the wash tank 110 and the curved plate 410 of the fluid-flow plate insert structure. The curved plate is attached to the bumpers via glue, welding or any other suitable attachment mechanism now known or hereinafter developed. In the embodiment shown, the bumpers are made of a rubber or plastic material to increase noise dampening. Nevertheless, it will be appreciated that any suitable material for the bumpers may be utilized without departing from the spirit and scope of the instant invention. In the embodiment shown, each of the bumpers generally span the length of the wash tank from side to side. Nevertheless, it will be appreciated that shorter bumpers and/or that a plurality of bumpers spaced along the length of the wash tank may be utilized without departing from the spirit and scope of the instant invention.

Figure 8:
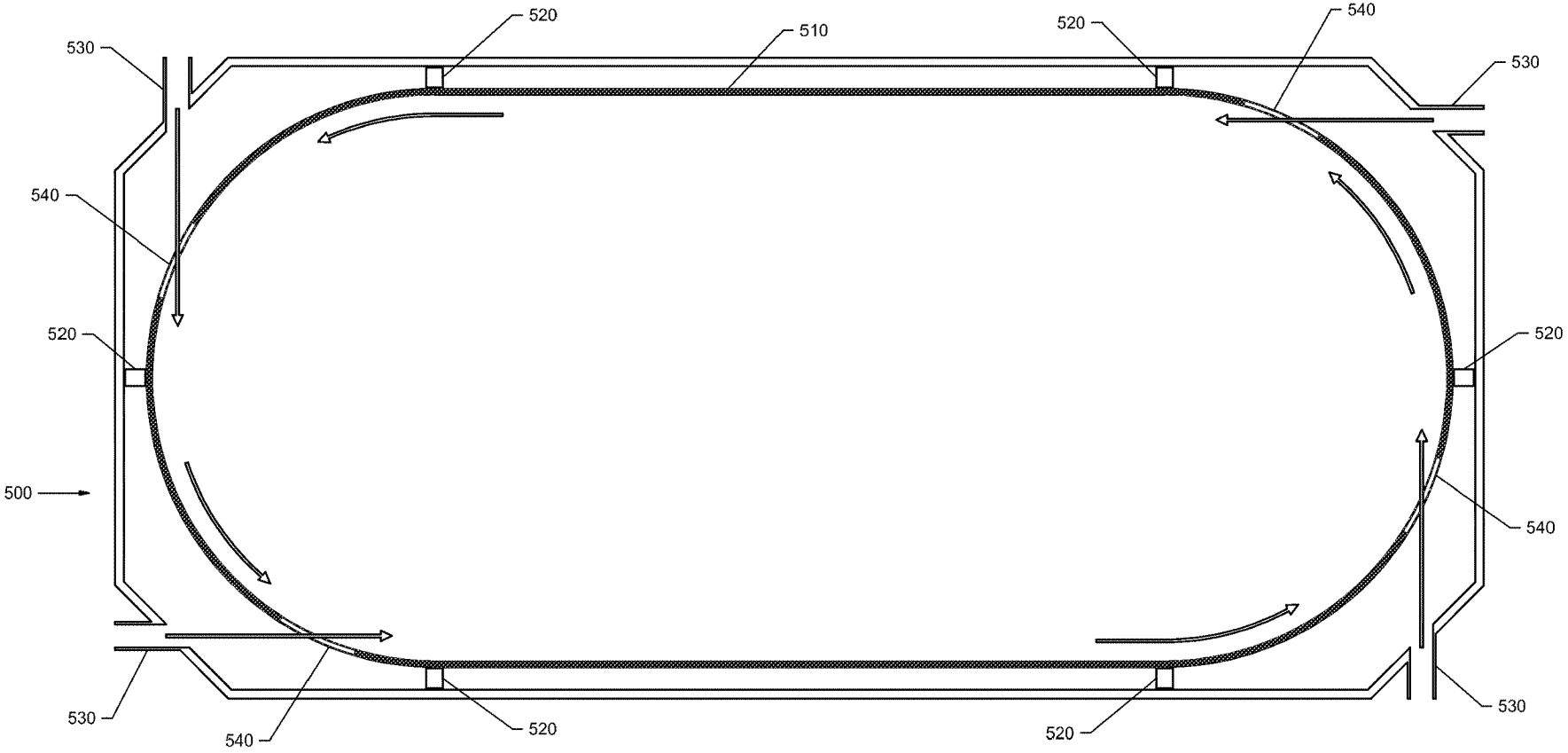
FIG. 8 is a top plan view of a pot and pan washing machine of the instant invention including a fluid-flow plate insert structure that is generally vertically orientated.

Referring to FIG. 8, a generally vertically orientated guide surface 510 is shown. The guide surface of FIG. 8 creates or improves a circulating wash action in the wash tank 500 about a generally vertical axis of the wash tank. The guide surface 510 is a generally closed or continuous elliptical planar looped member that is supported in a vertical position within wash tank 500. Support members or feet 520 help to support guide surface 510 and to maintain a gap or spacing between guide surface 510 and the walls of wash tank 500. The fluid flow guide surface 510 defines a washing area within the interior of the wash tank at the interior of the ellipse of the guide surface 510. The washing area is generally opposite the gap created between the fluid flow guide surface 510 and the walls of the wash tank 500. Jets 530 are angled create a circulating fluid flow within the wash tank 500. Openings 540 in the fluid flow guide surface 510 are located in association with each jet to allow the fluid flow to pass through openings 540 and into the washing area defined by the fluid flow guide surface 510.

Figure 9:
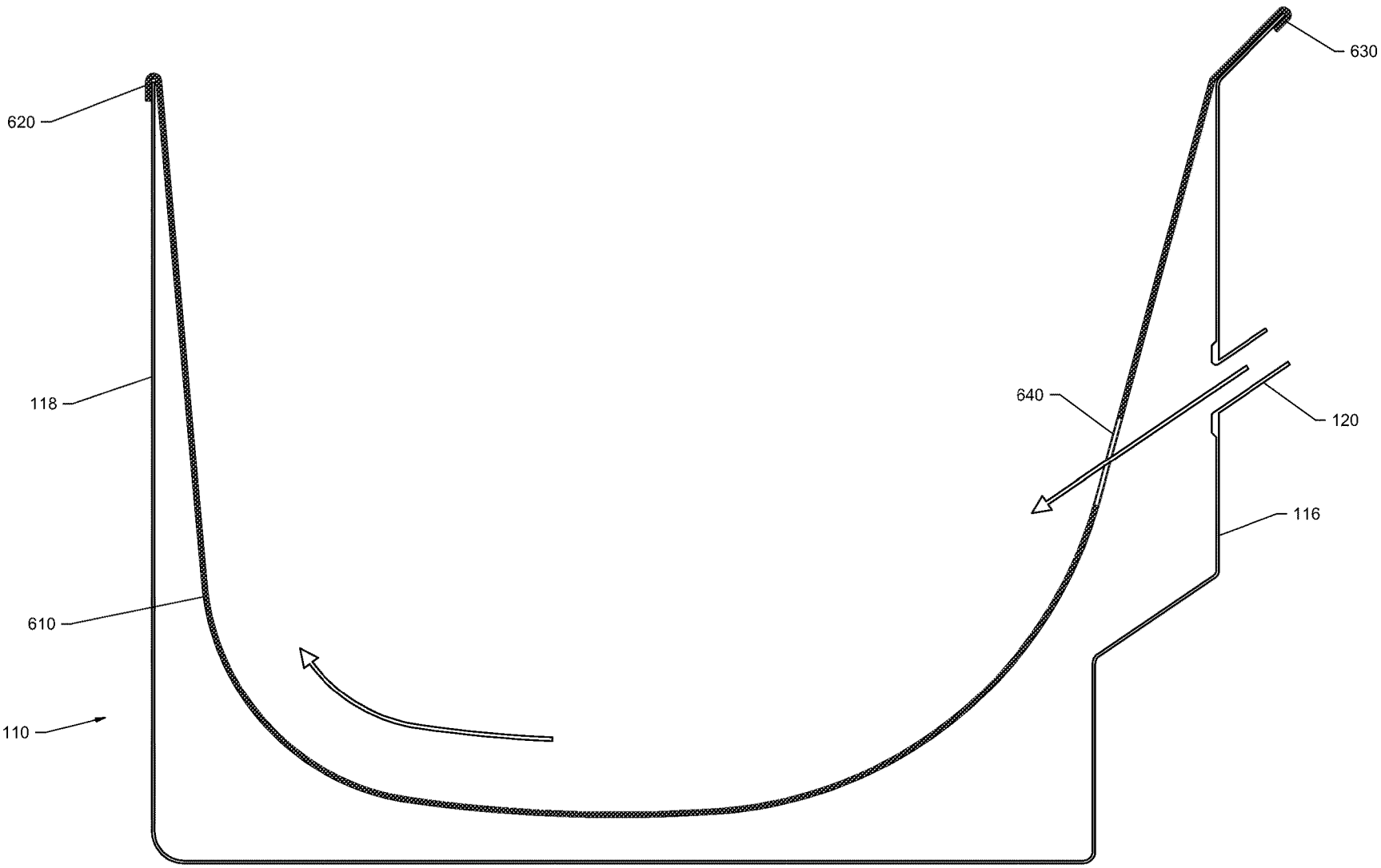
FIG. 9 is a side sectional view of another embodiment of a fluid-flow plate insert structure shown positioned within the wash tank of the pot and pan washing machine of FIG. 2.

Referring to FIG. 9, another embodiment of a generally horizontally orientated guide surface 610 is shown in connection with wash tank 110. The guide surface of FIG. 9 creates or improves a circulating wash action in the wash tank 110 about a generally horizontal axis of the wash tank. The guide surface 610 is removably supported within wash tank 110 via supports 620 and 630. Supports 620 and 630 are channels or hooks that basically hook over the lips at the top of the front and rear walls (respectively) of the wash tank. Openings 640 in the fluid flow guide surface 610 are located in association with each jet 120 of wash tank 110 to allow the fluid flow to pass through openings 640 and into the washing area defined by the fluid flow guide surface 610.

Figure 10:
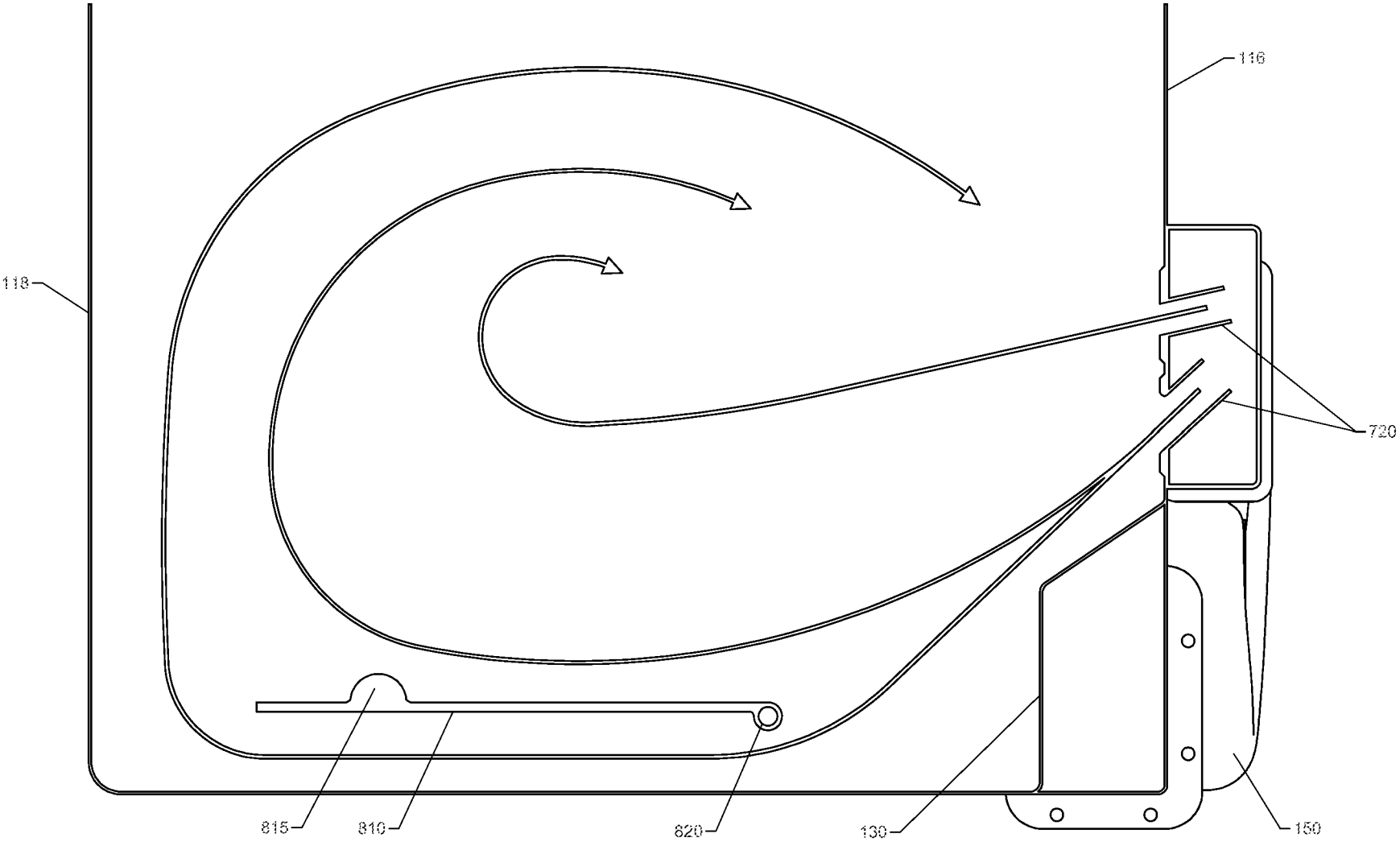
FIG. 10 is a cross-sectional side view of another embodiment of a fluid-flow plate insert structure shown positioned within the wash tank of the pot and pan washing machine of FIG. 2 that includes arrows indicating fluid flow paths within the wash tank.

FIG. 10 shows a pot and pan washing machine with a fluid-flow plate 810 at the lower portion of the wash tank 110. As shown in FIG. 10, the fluid-flow plate is generally rectangular in shape and extends in length from one end wall to the opposite end wall. As shown in FIG. 10, the fluid-flow plate includes a ridge 815 extending the length of the fluid-flow plate, parallel to the front and rear side walls of the wash tank. The ridge is located at an end opposite the jet nozzles 720 and/or rear side wall 116. The fluid-flow plate is pivotally attached to each of the opposite end walls via pivotal support 820. The fluid-flow plate 810 is generally planar. Although the fluid-flow plate is shown generally parallel to the bottom wall of the wash tank in FIG. 10, the end nearest the front side wall can move up or down in wavelike motions with fluid flow because the fluid-flow plate is attached to the wash tank only at one end, the end nearest the rear side wall.

FIG. 10 shows arrows indicating fluid flow paths within the wash tank. As shown in FIG. 10, fluid flow initiates from the jet nozzles 720 at the rear side wall 116. The jet nozzles are located at varying heights along the length of the rear wall of the wash tank, and discharge fluid at varying predetermined angles. As is shown in FIG. 10, a portion of the fluid is discharged at an angle to force the fluid flow under the fluid-flow plate. Fluid following this path flows under the fluid-flow plate and between the fluid-flow plate and the bottom wall. When the fluid hits the front side wall, the fluid is forced upward along the front side wall. The fluid eventually circulates along the top of the wash tank back toward the rear side wall and intake manifold.

As shown in FIG. 10, a portion of fluid is discharged at a downward angle toward the top of the fluid-flow plate. This fluid is then forced along the top of the fluid-flow plate until it reaches the ridge. When it reaches the ridge, the fluid is forced upward toward the top of the wash tank by the ridge.

The fluid eventually circulates along the top of the wash tank back toward the rear side wall and intake manifold.

Also as is shown in FIG. 10, a portion of the fluid is discharged at an angle generally forward toward the front wall of the wash tank. This fluid jet stream is not intended to deflect from either the bottom of the wash tank or from the fluid-flow plate. It will be appreciated that although shown as a generally downward angle, the forward fluid flow angle may be generally level, generally level or generally upward without departing from the spirit and scope of the instant invention. In a preferred embodiment, the forward fluid flow is a piercing flow that comprises a generally lower volumetric flow rate than the portions of fluid that are discharged downward toward or under the fluid-flow plate. In this manner the piercing flow aids in rotation of items being washed and performs the majority of washing.

Depending on the force of the fluid under the fluid-flow plate compared to the force of the fluid along the top of the fluid-flow plate, and also depending on whether other items (e.g. pots and pans, produce, etc.) are colliding with the top of the fluid-flow plate, the fluid-flow plate of FIG. 10 oscillates in an up and down motion at the front end. The location of the fluid-flow plate and/or the oscillating motion of the fluid-flow plate helps to prevent pans and other items from sticking and/or striking to the bottom of the wash tank, thus providing a more efficient and quieter rolling action within the wash tank.

In one embodiment, the fluid-flow plate(s), discussed above in connection with any of the embodiments discussed in connection with any of FIGS. 1-10, is (are) made from stainless steel. In another embodiment, the fluid-flow plate and/or other components of the wash tank are made from a vibration damping material, such as QUIET STEEL (available from Material Sciences Corporation), plastic, or other suitable material. As objects are washed and turned in the rolling motion of the wash tank, they frequently collide with the front and bottom. Such collisions can cause elevated decibel levels. A wash tank made of ordinary stainless steel combined with a fluid-flow plate made from a vibration damping material will keep noise levels within more tolerable limits as the pots and pans or other items will strike the fluid-flow plate rather than the bottom of the wash tank. Moreover, the pivotal connection or oscillating/flexible motion of the fluid-flow plate itself dampens the impact between pots and pans and the fluid-flow plate.

In one embodiment of the fluid flow plate of FIG. 10, a single plate 810 spans the length of the wash tank. In another embodiment, multiple plates are positioned side by side to cover generally the entire lower portion of the wash tank. Each fluid-flow plate is generally rectangular in shape and extends in width generally from the rear wall to the front wall of the wash tank. Each fluid-flow plate extends in length a portion of the length between the end walls of the wash tank, such that the multiple fluid-flow plates positioned side by side fully cover the entire width of the wash tank. Each fluid-flow plate is separately mounted to the wash tank, to allow each plate to oscillate independently from one another. It will be appreciated that the size, shape, number and other structural elements (such as openings) of each or several individual plate(s) may vary without departing from the spirit and scope of the instant invention. Moreover, it will be appreciated that a single type of fluid flow plate may be utilized in the wash tank, combinations of various types of fluid flow plates may be utilized in the wash tank, or portions of the wash tank may utilize no fluid flow plate at all.

In an embodiment similar to that of FIG. 10, the fluid flow plate 810 is connected to the rear wall 116 or intake manifold 130 of the wash tank and extends generally toward the front wall 118. A first, generally circular opening is located toward the end of the plate that is located along the rear wall of the wash tank (i.e. closest to the jets of the wash tank). This opening is sized to allow a jet stream from jets that are angled downward to flow through the opening and under the plate (similar to the flow shown in FIG. 10). A plurality of small, oval-shaped, openings are located toward the front end of the plate opposite the rear wall of the wash tank. These openings allow the fluid that is flowing under the plate to be directed upward toward the front of the wash tank (similar to the flow shown in FIG. 10). A pair of generally rectangular openings is located toward the rear-most end of the plate to allow the plate the be attached to tabs/fingers that are protruding from/near the rear wall of the wash tank. In this manner, each plate is mounted within the wash tank to allow the plates to oscillate independently from one another. In one embodiment, the fingers on which the plates are mounted include a gap at the top (between the finger and the rear wall or intake of the tank), such that the plates may be attached or removed by system users. In an alternative embodiment, no gap exists, such that the plates are permanently mounted within the wash tank. In one embodiment, one of multiple plates within the wash tank differs from the remaining plates. The one plate that differs from the other plates is twice as wide as the other plates described above. One half of the width of the plate includes holes that are identical to those described above. The other half includes only the rectangular mounting holes. The remainder of the plate includes no openings. This section of the plate is intended to generally maintain the wash action created by the jets without allowing any portion of the fluid expelled from the jets to flow under the plate. Such an arrangement may be utilized in connection with a wash tank in which a powered utensil basket is utilized that itself captures a jet stream within the basket.

In another embodiment similar to those discussed above with respect to FIG. 10, each flow plate is attached to the rear wall of the wash tank via a c-channel bracket that clamps around the top and bottom of the rear end of the plate. The bracket is attached to the rear wall of the wash tank via tabs or hooks on the bracket that correspond to mating tabs, notches or hooks on the rear wall of the wash tank. In one embodiment, tabs/hooks on the bracket are inserted into slots/notches located in an intake grate that extends along the rear wall of the wash tank.

In another embodiment similar to that of FIG. 10, each plate extends from the rear wall of the wash tank and fades into the radius of a tank insert that extends from the top of the front wall of the wash tank downward along the inner surface of the front wall of the wash tank, and then along the bottom of the wash tank toward the rear wall of the wash tank. The radius portion of the tank insert creates a segregated area between the front bottom corner of the wash tank and the insert. The insert includes a jog section toward the top of the front wall to create a gap between the front wall of the wash tank and the front of the insert. The gap extends down into and merges with the segregated area. This segregated area (and gap) will retain generally static fluid (i.e. fluid that does not exhibit as high a degree of flow as fluid on the interior side of the insert) from the wash tank due to holes in the insert and/or unsealed gaps between the walls of the wash tank and the edges of the insert. The generally static fluid acts as a hydraulic damper to reduce noise when a pot, pan or other item being rotated within the interior section of the insert strikes a surface of the insert.

In one embodiment discussed above, the bottom wall of the tank insert becomes generally flush with the bottom wall of the wash tank and extends to the rear wall of the wash tank. Nevertheless, it will be appreciated that a gap may be created between the bottom wall of the wash tank and the bottom wall of the insert to increase noise reduction from pot, pan or other items striking that area. In some embodiments, a gap is provided between the fluid flow plate and the bottom wall of the insert. This gap too acts as a hydraulic damper in the same or similar manner to the flow plates of embodiments discussed above. Fluid flows from the jet of the wash tank through the hole in the rear of the flow plate and underneath the flow plate toward the front wall of the wash tank. The fluid follows the radius of the insert upward and urges the front of the flow plate upward as it flows out from under the flow plate. This cause the flow plate to oscillate in the same or similar manner discussed above with respect to other embodiments.

In one embodiment in which a separate utensil flow plate for a utensil washing area differs from other flow plates within the wash tank, the utensil plate is attached to the rear wall (or rear intake grate) of the wash tank in the same or similar manner to plates discussed above via a c-channel bracket. The utensil plate extends from the rear wall of the wash tank toward the front wall of the wash tank. The utensil plate curves upward toward the front wall of the wash tank to create a radius and segregated area (and gap) similar to that of the wash tank insert discussed above. The front end of the utensil plate includes a lip that hooks into a channel or shelf ridge located in a support bracket for a wash tank partition plate. The front portion of the utensil plate tapers upward from an end of the wash tank toward the interior of the wash tank. This creates a ramp from the end of the wash tank toward the interior of the tank. As fluid flows from the jets across the top of the utensil plate, the ramp urges the fluid toward the interior of the wash tank. This results in utensils and other items that are located in the utensil area (i.e. above the utensil plate and between the end of the wash tank and the partition plate) to be urged upward toward the front of the wash tank and against the partition plate, such that the items may easily be retrieved from the wash tank by an operator.

In another embodiment the divider discussed above is held in position within the wash tank via a pair of support brackets. A first support bracket is located along the front wall of the wash tank. The front bracket includes a lip that wraps around the top of the front wall of the wash tank to hold the bracket in position. A rectangular body extends downward from the lip along the interior of the front wall of the wash tank. The body includes a pair of rails that form a slot in which the divider/partition is retained. The rear bracket includes a body section that also includes rails that form a slot for retaining the rear end of the divider. The rear bracket is attached to the rear wall of the wash tank via interconnecting hooks or tabs.

Although the gap created between the fluid flow guide surface by the supports in all of the embodiments shown in FIGS. 1-10 herein, include voids in which fluid will flow or stand when the wash tank is full of fluid, it will be appreciated that other embodiments include no such voids. For example, in one embodiment, the support for the guide surface is made of a solid piece of material that includes an exterior shape that abuts against the walls of the wash tank, and an interior shape that is contoured to define the desired wash area within the fluid flow guides surface.

The location and shape of the fluid-flow plate structure and/or the oscillating or flexing motion of the fluid-flow plate structure of the embodiments discussed above with respect to FIGS. 1 through 10 helps to prevent pans and other items from sticking and/or striking to the bottom of the wash tank, thus providing a more efficient and quieter rolling action within the wash tank. This results in an improved flow pattern within the wash tank, faster washing due to items being located in front of the wash jets more times and at different orientations, and increased wash efficiency with more items being washed in less time. In addition, the improved flow allows items to be delivered to operators of the machine as it pushes items toward the top and front of the wash tank.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A fluid flow structure for a washing machine wash tank the fluid flow structure comprising:

a fluid flow guide surface, said guide surface being generally curved and including at least one region contoured inconsistently from the contour of at least one corresponding wall of the washing machine wash tank; and a support for said guide surface, wherein said support creates a gap between said guide surface and an interior surface of at least one wall of the washing machine wash tank;

wherein said guide surface and/or said support are capable of flexible motion independent of the walls of the washing machine wash tank;

wherein said fluid flow structure is positioned to direct a portion of fluid along the fluid flow guide surface;

wherein said guide surface is removably positioned within the washing machine wash tank; and wherein said support is removably positioned within the washing machine wash tank.

2. The fluid flow structure as claimed in claim 1 wherein said flexible motion at least partially isolates impacts, noise or other vibrations acting on the guide surface from acting on the walls of the washing machine wash tank.

3. The fluid flow structure as claimed in claim 1 wherein said guide surface and/or said support are made of a non-metallic flexible material that absorbs vibrations.

4. A washing machine comprising:

a generally rectangular wash tank including a bottom wall, two side walls and two end walls extending upwardly from said bottom wall, said side walls being longer than said end walls;

at least one flow directional opening in at least one of said walls;

at least one fluid flow structure within said wash tank, the structure comprising:

a fluid flow guide surface, said guide surface being generally curved and including at least one region contoured inconsistently from the contour of at least one corresponding wall of the washing machine wash tank; and a support for said guide surface, wherein said support creates a gap between said guide surface and at least one wall of the washing machine wash tank;

wherein said fluid flow structure is positioned within the generally rectangular wash tank to direct a portion of fluid along the fluid flow guide surface.

5. The washing machine as claimed in claim 4 wherein said fluid flow guide surface defines a washing area within said wash tank, said washing area being generally opposite said gap with respect to said fluid flow guide surface.

6. The washing machine as claimed in claim 5 wherein said at least one flow directional opening introduces fluid within said washing area.

7. The washing machine as claimed in claim 4 wherein said at least one flow directional opening comprises a plurality of flow directional openings positioned along one of said side walls.

8. The washing machine as claimed in claim 7 further comprising:

an intake positioned generally along one of said side walls; and a divider member positioned between two of said flow directional openings.

9. The washing machine as claimed in claim 8 wherein said divider member is held within a gap created between two adjacent fluid flow structures within the wash tank.

10. The washing machine as claimed in claim 8 wherein said intake comprises a void within at least a portion of said gap.

* * * * *